United States Patent [19]

Barge et al.

[11] 4,157,975

[45] Jun. 12, 1979

[54] ELECTRICAL INSULATORS HAVING INCREASED RESISTANCE TO PARTIAL DISCHARGES

[75] Inventors: Jean Barge, Paris la Defense; Raymond Catté, Lacq; Gilbert Chapelet, Symphorien d'Ozon; Ai Bui, Toulouse; Pierre Dejean, Sens; Claude Huraux; Christian Mayoux, both of Toulouse, all of France

[73] Assignee: Agence Nationale de Valorisation de la Recherche (ANVAR), Neuilly-sur-Seine, France

[21] Appl. No.: 697,063

[22] Filed: Jun. 17, 1976

Related U.S. Application Data

[63] Continuation of Ser. No. 588,209, Jun. 19, 1975, abandoned.

[30] Foreign Application Priority Data

Jun. 21, 1974 [FR] France ..... 74 21778

[51] Int. Cl.[2] ..... H01B 3/30; H01B 3/40; H01B 3/42

[52] U.S. Cl. ..... 252/63.5; 174/110 R; 174/110 PM; 174/110 E; 174/127; 252/63; 252/63.2; 260/45.75 R; 252/64; 260/429 J

[58] Field of Search ..... 260/45.75 R, 45.85 E, 260/2 A, 429 J; 174/213; 317/258; 252/63.5, 63, 63.2, 64; 174/110 R, 110 PM, 110 E, 127

[56] References Cited

U.S. PATENT DOCUMENTS

| | | | |
|---|---|---|---|
| 2,465,296 | 3/1949 | Swiss | 260/429 J |
| 2,615,860 | 10/1952 | Burgess | 260/429 J |
| 3,272,853 | 9/1966 | Braum | 260/429 J |
| 3,291,660 | 12/1966 | Oberth et al. | 260/77.5 AB |
| 3,577,346 | 5/1971 | McKeown | 252/63.5 |
| 3,631,146 | 12/1971 | Briggs et al. | 260/45.75 N |
| 3,649,542 | 3/1972 | Hasebe et al. | 252/63.5 |
| 3,946,057 | 3/1976 | Reedy | 260/429 J |

*Primary Examiner*—John D. Smith

*Attorney, Agent, or Firm*—Sprung, Felfe, Horn, Lynch & Kramer

[57] ABSTRACT

The invention relates to electrical insulators having increased resistance to partial discharges and electrical equipment comprising such electrical insulators.

These electrical insulators are formed of a macromolecular material in which is incorporated a chelate of general formula:

$$\left[ R_1-\underset{\underset{X}{\|}}{C}-\underset{\underset{R_2}{|}}{C}=\underset{\underset{Y^-}{|}}{C}-R_3 \right]_n M^{n+} \qquad (I)$$

wherein:

$R_1$, $R_2$ and $R_3$ each represent hydrogen or a alkyl, aryl, or cycloalkyl group or a heterocyclic group containing a sulphur, oxygen or nitrogen atom, whereby said group or heterocyclic group may be substituted by one or more halogen atoms;

X and Y represent oxygen or sulphur;

the total number of carbon atoms in the metal chelate is between 5 and 25;

$M^{n+}$ stands for a metal ion, and n is an integer from 1 to 4, this enolate or thioenolate being present in said insulating material in a sufficient amount for promoting extinction of partial discharges, said amount not exceeding a value which would substantially alter the physical properties of the insulator, such as its volume resistivity.

22 Claims, 1 Drawing Figure

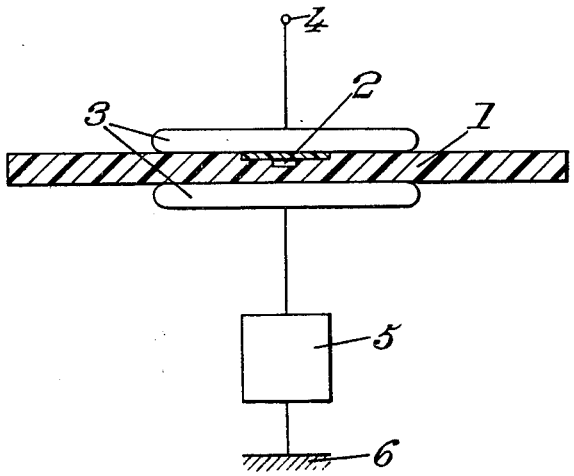
4
2
3
1
5
6

ELECTRICAL INSULATORS HAVING INCREASED RESISTANCE TO PARTIAL DISCHARGES

CROSS REFERENCE TO RELATED APPLICATIONS

This application is a continuation of Ser. No. 588,209, filed June 19, 1975, now abandoned, which claims the priority of French application No. 74 21778, filed June 21, 1974.

BACKGROUND OF THE INVENTION

The invention relates to electrical insulators formed from macromolecular materials having improved properties in particular with respect to partial discharges.

It is known that, owing to imperfect homogeneity, macromolecular insulating materials comprise minute cavities or voids which often contain a gas, especially air. when the insulator is subjected to an electrical field, a fraction of the latter is established between the opposite faces of the voids. These phenomena are referred to hereafter as partial discharges in the insulators. The existence of such partial discharges eventually causes an erosion of the insulating material. In spite of efforts expended for obtaining as homogenous materials as possible, the voids are never entirely eliminated. From a practical standpoint, partial discharges may occur in all insulating systems subjected to high electrical fields. The problem is of the greatest inportance in the case of insulating sheaths for electrical power lines, or capacitor dielectrics.

The invention aims to provide an electrical insulator in which the partial discharges and the resulting erosion are eliminated or at least greatly reduced. The invention aims at obtaining this result without otherwise modifying the properties of the insulator. The invention further aims to provide electrical equipment in which high electrical fields are liable to appear, and comprising at least one electrical conductor, in contact with an insulator, said electrical equipment being efficiently protected against partial electrical discharges which may occur within the insulator.

DETAILED DESCRIPTION OF THE INVENTION

The electrical insulator according to the invention is essentially formed of a macromolecular material containing an agent improving its resistance to partial discharges under high electric fields, said agent being incorporated into the macromolecular material and comprising at least one metal chelate formed by an enolate or thioenolate of the general formula:

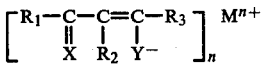

(I)

wherein:

$R_1$, $R_2$ and $R_3$ each represent hydrogen or an alkyl, aryl, or cycloalkyl group or a heterocyclic group containing a sulphur, oxygen or nitrogen as the heterocyclic atom, whereby said group or heterocyclic group may be substituted by one or more halogen atoms;

X and Y represent oxygen or sulphur;

the total number of carbon atoms in the metal chelate is between 5 and 25;

$M^{n+}$ stands for a metal ion, and n is an integer from 1 to 4, this enolate or thioenolate being present in said insulating material in an amount sufficient to promote extinction of partial discharges, said amount not exceeding a value which would substantially alter the macromolecular dielectric properties of the insulator, such as its volume resistivity.

The electrical equipment, according to the invention, in which high electrical fields are liable to appear, and which comprises at least one electrical conductor in contact with an insulator, is characterized in that the insulator contains at least one metallic chelate as defined above incorporated therein.

It has been noted that the incorporation of such enolate or thioenolate into the insulator material considerably decreased the phenomena of partial discharges therein, without substantially modifying their other dielectric properties.

A preferred family of especially suitable enolates or thioenolates for use in the present invention is formed of compounds in which $R_1$, $R_2$ and $R_3$ are alkyl, or of haloalkyl groups containing from 1 to 6 carbon atoms, phenyl groups or heterocyclic groups having 5 or 6 members, the heteroatoms of which are sulphur, oxygen or nitrogen. There will be specifically mentioned compounds of general formula I in which $R_1$, $R_2$ and $R_3$ have respectively the following meanings:

| | | |
|---|---|---|
| methyl | H | methyl |
| methyl | H | isobutyl |
| methyl | H | thenoyl |
| trifluoromethyl | H | trifluoromethyl |
| methyl | H | pyridyl |
| methyl | H | furyl |
| phenyl | H | cyclohexyl |
| hexyl | H | isobutyl |
| methyl | methyl | methyl |
| methyl | hexyl | methyl |

Metals of these enolates or thioenolates are among others:

either transition metals such as iron, copper, chromium, titanium, zirconium, vanadium, manganese, mercury or hafnium;

other metals such as sodium, potassium, barium and aluminium;

A preferred enolate for embodying the present invention is characterized by formula:

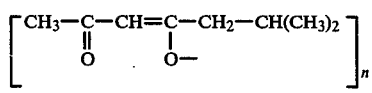

(II)

in which the ion $M^{n+}$ is one of the following:

$Fe^{3+}$, $Zr^{4+}$, $Cu^{2+}$, $Cr^{3+}$, $Ce^{4+}$, $Ti^{3+}$, $Al^{3+}$, $V^{3+}$

Preferred metals are iron and titanium.

It is of great interest to note that the effect sought is obtained with very low proportions of these enolates or thioenolates. Thus an effect has been detected for enolate or thioenolate contents as low as 0.001% by weight with respect to the macromolecular compound. Generally these compounds are used in proportions between about 0.001 and about 5% and preferably between 0.01 and 1% by weight.

The insulators can be formed starting from a large variety of macromolecular compounds, particularly all macromolecular compounds used or usable in the production of insulating material, for example polymers such as polyethylenes, polycondensates such as polyesters, or polyaddition compounds such as polyepoxydes.

The invention is advantageously applied to polyethylenes in particular to "low-density polyethylenes" which are free from metal traces.

Concerning the mode of action of enolates or thioenolates in the macromolecular compound, the following hypothesis can be put forth:

The extinction of partial discharges could be due to a local decrease of surface resistivity of the walls of the voids under the effect of these discharges, as the results of the subsequently presented tests seem to show.

This local decrease of surface resistivity of the walls of the voids could be explained by the rupture, caused by the partial discharges, of links between the metal ion and the remaining portion of the organic molecule of the enolate or thioenolate. This appears to induce a local release of metal exclusively on the walls of the voids or similar cavities. The metal release would therefore be associated with a local increase of conductivity preventing the formation of a partial arc in the less conductive gas within the voids, thereby causing an elevation of the threshold voltages beyond which partial arcs are likely to be produced.

This threshold voltage increase, i.e. the increase of the voltage above which partial discharges appear in the insulator, has been observed in the macroscopic system described hereafter.

It has surprisingly been noted that to the contrary, the dielectric properties of the modified insulators of the invention are not altered. As a practical matter the volume resistivity, the surface resistivity at macroscopic scale and the dielectric rigidity of the insulating material incorporating the chelates of Formula I are not substantially modified.

The interest in using enolates and thioenolates for increasing the resistance of insulators to partial discharges resides in the fact that the metals which they contain remain trapped within the organic molecule so that, at a macroscopic scale, such metals do not substantially alter the dielectric properties of the insulator insofar as the molecules of the chelate under consideration are not directly affected by the arcs.

An original character of the invention is that such chelates do not significantly alter the conductivity or dielectric rigidity properties of the insulator and exert their action under the influence of the discharges exclusively at the precise location where they appeared. This appears to limit the possibility of particle migration under the action of the electric field.

In the tests described hereafter, use has been made of low-density polyethylene samples available under the trade name LACQTENE 1020 FN 18 containing various amounts of metal enolates of formula II.

1.—Determination of the Threshold Voltage Increase Measurable in These Samples Upon Incorporation of an Enolate of the Aforesaid Type Referring to the drawing and FIGURE use is made of samples 1 containing 0.1% of titanium enolate. These samples are 1 mm thick square platelets, the sides of which have a 7 mm size. They comprise in their center a macroscopic void 2, having 0.30 mm depth and 3 mm diameter. This sample is placed between two electrodes 3, having a 50 mm diameter, these electrodes being connected to a high voltage A.C. source 4 which is operated at a frequency of 50 Herz. The discharges are ascertained by means of a detector 5, located between ground 6 and the sample 1.

As shown in the following table, the samples which have been previously subjected to partial discharges during the time periods indicated exhibit threshold voltage values substantially higher than those of similar samples which have not previously been subjected to such partial discharges.

No substantial modification of the threshold voltages is obtained on control samples of polyethylene containing no metal enolate which have been first subjected to partial discharges.

| Time of exposure to partial discharges (hours) | kV | Ratio of threshold voltage after exposure to partial discharges to original threshold voltage |
|---|---|---|
| 0 | 4 | 1 |
| 6 | 8 | 2 |
| 10 | 11 | 2.7 |

In the foregoing tests, the shape and the size of the artificial void were by far more unfavourable than natural voids found in ordinary insulating materials. The effect obtained under these conditions is accordingly highly significant.

2.—Comparative Tests Between Polyethylene Samples Modified in Accordance with the Invention and Control Samples The samples used are made of the same polyethylene containing various concentrations of different enolates, and more specifically, metallic 3-enolates of methyl-6-heptanedione-2-4 containing the following cations (an indication is also given concerning the metal content and the initial state of the corresponding chelate):

$Fe^{3+}$ (Fe content: 8.65%)—iron chelate (solid)
$Zr^{4+}$ (Zr content: 11.4%)—zirconium chelate (solid)
$Cu^{2+}$ (Cu content: 18.4%)—copper chelate (solid)
$Cr^{3+}$ (Cr content: 8.6)—chromium chelate (liquid)
$Ce^{4+}$ (Ce content: 20.9%)—cerium chelate (solid)
$Ti^{3+}$ (Ti content: 8.1%)—titanium chelate (liquid)
$Al^{3+}$ (Al content: 6%)—aluminum chelate (liquid)
$V^{3+}$ (V content: 10.5%)—vanadyl chelate (liquid)

Tested samples have been either subjected or not subjected to discharges in air and, in the case of some of, they have been treated under an atmosphere of argon or nitrogen. The various enolates differ by the metal included in the structure thereof.

Previous tests have shown that even the higher enolate concentrations do not induce substantial modifications of the dielectric rigidity of the test samples.

The surface and volume resistivities have been measured in accordance with ASTM D-257 (part 27) standards. In the tests carried out under an atmosphere of air or nitrogen, the measurements have been effected under an RMS voltage of 4.5 kV, the gas layer between the test sample and the measuring electrode being 0.7 mm thick. In the tests effected under argon, the RMS voltage used was 1.7 kV and the distance between the measuring electrode and the sample was 1 mm.

The following tables show the values of volume and surface resistivities measured both on control samples and on various samples containing increasing amounts of the enolates under consideration, before and after being subjected to discharges in air. In the left columns of the tables are shown the atmospheres in which the measurements have been made. The term "exposed" means that said samples have been subjected over nine hours to partial discharges before taking the measurements.

"P.E. Lactene 1020 FN 18" + iron chelate

| Electrical characteristics | Concentration of additive (% by weight) | 0 | 0,01 | 0,05 | 0,1 |
|---|---|---|---|---|---|
| not "exposed" | ρ v Ω cm | ≧$10^{19}$ | $10^{19}$ | $10^{19}$ | $10^{19}$ |
| | ρ s Ω | ≧$10^{19}$ | $10^{19}$ | $10^{19}$ | $10^{19}$ |
| partially "exposed" | ρ v Ω cm | $10^{18}$ | $10^{17}$ | $10^{17}$ | $10^{17}$ |
| in air | ρ s Ω | $10^{18}$ | $10^{11}$ | $5 \times 10^{10}$ | $7 \times 10^{10}$ |
| "exposed" in | ρ v Ω cm | | | | $10^{17}$ |
| nitrogen | ρ s Ω | | | | $10^{13}$ |
| "exposed" in | ρ v Ω cm | | | | $10^{17}$ |
| argon | ρ s Ω | | | | $10^{13}$ |

"P.E. Lactene 1020 FN 18" + titanium chelate

| Electrical characteristics | Concentration of additive (% by weight) | 0 | 0,01 | 0,05 | 0,1 |
|---|---|---|---|---|---|
| not "exposed" | ρ v Ω cm | ≧$10^{19}$ | $10^{19}$ | $10^{19}$ | $10^{19}$ |
| | ρ s Ω | ≧$10^{19}$ | $10^{19}$ | $10^{19}$ | $10^{19}$ |
| "exposed" in air | ρ v Ω cm | $10^{18}$ | $10^{17}$ | $10^{17}$ | $10^{17}$ |
| | ρ s Ω | $10^{18}$ | $6 \times 10^{12}$ | $5 \times 10^{12}$ | $6 \times 10^{12}$ |
| "exposed" in | ρ v Ω cm | | | | $10^{17}$ |
| nitrogen | ρ s Ω | | | | $10^{14}$ |
| "exposed" in | ρ v Ω cm | | | | $10^{17}$ |
| argon | ρ s Ω | | | | $10^{15}$ |

"P.E. Lactene 1020 FN 18" + chromium

| Electrical characteristics | Concentration of additive (% by weight) | 0 | 0,01 | 0,05 | 0,1 |
|---|---|---|---|---|---|
| not "exposed" | ρ v Ω cm | ≧$10^{19}$ | $10^{19}$ | $10^{19}$ | $10^{19}$ |
| | ρ s Ω | ≧$10^{19}$ | $10^{19}$ | $10^{19}$ | $10^{19}$ |
| partially "exposed" | ρ v Ω cm | $10^{18}$ | $10^{17}$ | $2 \times 10^{16}$ | $1,6 \times 10^{14}$ |
| in air | ρ s Ω | $10^{18}$ | $6 \times 10^{14}$ | $8 \times 10^{12}$ | $2 \times 10^{11}$ |

"P.E. Lactene 1020 FN 18" + zirconium chelate

| Electrical characteristics | Concentration of additive (% by weight) | 0 | 0,01 | 0,05 | 0,1 |
|---|---|---|---|---|---|
| not "exposed" | ρ v Ω cm | ≧$10^{19}$ | $10^{19}$ | $10^{19}$ | $10^{19}$ |
| | ρ s Ω | ≧$10^{19}$ | $10^{19}$ | $10^{19}$ | $10^{19}$ |
| partially "exposed" | ρ v Ω cm | $10^{18}$ | $10^{17}$ | $10^{17}$ | $7 \times 10^{16}$ |
| in air | ρ s Ω | $10^{18}$ | $10^{14}$ | $10^{14}$ | $8 \times 10^{13}$ |

"P.E. Lactene 1020 FN 18" + cerium chelate

| Electrical | Concentration of additive (% by weight) | 0 | 0.01 | 0.05 | 0.1 |
|---|---|---|---|---|---|

-continued

| characteristics | | | | | |
|---|---|---|---|---|---|
| not "exposed" | ρ v Ω cm | ≧ $10^{19}$ | $10^{19}$ | $10^{19}$ | $10^{19}$ |
| | ρ s Ω | ≧ $10^{19}$ | $10^{19}$ | $10^{19}$ | $10^{19}$ |
| partially "exposed" | ρ v Ω cm | $10^{18}$ | $10^{17}$ | $6 \times 10^{16}$ | $2 \times 10^{16}$ |
| in air | ρ s Ω | $10^{18}$ | $6 \times 10^{15}$ | $8 \times 10^{14}$ | $1,5 \times 10^{14}$ |

"P.E. Lactene 1020 FN 18" + aluminum chelate

| Electrical characteristics | Concentration of additive (% by weight) | 0 | 0,01 | 0,05 | 0,1 |
|---|---|---|---|---|---|
| not "exposed" | ρ v Ω cm | ≧ $10^{19}$ | $10^{19}$ | $10^{19}$ | $10^{18}$ |
| | ρ s Ω | ≧ $10^{19}$ | $10^{19}$ | $10^{19}$ | $10^{19}$ |
| partially "exposed" | ρ v Ω cm | $10^{18}$ | $1,5 \times 10^{16}$ | $10^{16}$ | $10^{16}$ |
| in air | ρ s Ω | $10^{18}$ | $2 \times 10^{14}$ | $1.7 \times 10^{14}$ | $1.5 \times 10^{14}$ |

"P.E. Lactene 1020 FN 18" + vanadyl chelate

| Electrical characteristics | Concentration of additive (% by weight) | 0 | 0.01 | 0.05 | 0.1 |
|---|---|---|---|---|---|
| not "exposed" | ρ v Ω cm | ≧ $10^{19}$ | $10^{19}$ | $10^{19}$ | $10^{19}$ |
| | ρ s Ω | ≧ $10^{19}$ | $2.5 \times 10^{18}$ | $10^{18}$ | $8 \times 10^{17}$ |
| partially "exposed" | ρ v Ω cm | $10^{18}$ | $10^{17}$ | $6 \times 10^{16}$ | $10^{16}$ |
| in air | ρ s Ω | $10^{18}$ | $10^{12}$ | $10^{12}$ | $10^{12}$ |

"P.E. Lactene 1020 FN 18" + copper chelate

| Electrical characteristics | Concentration of additive (% by weight) | 0 | 0,01 | 0,05 | 0,1 |
|---|---|---|---|---|---|
| not "exposed" | ρ v Ω cm | ≧ $10^{19}$ | $10^{18}$ | $8 \times 10^{17}$ | $2 \times 10^{17}$ |
| | ρ s Ω | ≧ $10^{19}$ | $2 \times 10^{17}$ | $10^{17}$ | $2 \times 10^{16}$ |
| partially "exposed" | ρ v Ω cm | $10^{18}$ | $6 \times 10^{16}$ | $4 \times 10^{16}$ | $2 \times 10^{16}$ |
| in air | ρ s Ω | $10^{18}$ | $4 \times 10^{14}$ | $5 \times 10^{14}$ | $4 \times 10^{14}$ |

As made clear upon considering the tables, significant results are obtained with concentrations of enolates as low as 0.01% by weight. An examination of the tables shows in the first place that introduction of enolates, independently of the concentration thereof, does not substantially modify the values of volume resistivity of polyethylene, when the samples have not been subjected to discharges. Only copper and vanadium enolates induce a very slight modification of said parameters.

For samples having been subjected to discharges, it will be noted that the volume resistivity is substantially not modified and at most undergoes a slight change. One should note especially the remarkable stability of the volume resistivities of samples containing iron and titanium enolates.

To the contrary, the surface resistivity from a macromolecular standpoint, i.e., in the region of the test void 2 exhibits very substantial changes even at very low enolate concentrations. The variations are more pronounced for samples having been subjected to discharges in air.

The most substantial variations have been obtained with iron and titanium enolates.

The introduction of enolate or thioenolate in the macromolecular compounds can be effected by all known means for introduction of additives. Owing to the fact that the concentration of the chelate in the macromolecular material is very low and that the dispersion must be homogeneous it is advisable to prepare the mixture in two stages. In a first stage one prepares a pre-mixture of the whole chelate in but a portion of the macromolecular material to be treated. This pre-mixture, also called the "master mixture," is then mixed with the remaining portion of the macromolecular material.

In addition, some conventional additives such as antioxidants (phenol) derivatives, diphenylparaphenylenediamine, etc.) can be incorporated, preferably together with the chelates, into the insulating materials.

Materials in accordance with the invention can be used for numerous applications in electrical industries, for instance for the production of insulation sheaths for high voltage electric power lines, molded insulators for electric apparatus, capacitor dielectrics, etc.

Preferred uses of the electric insulators according to the invention are in equipment subject to high electrical fields, and particularly in insulating sheaths for high voltage electric power lines, particularly those subjected to voltages as high as 50 to 100 kV, or more.

We claim:

1. An electrical insulator formed of a void-containing macromolecular polymer for use under voltages capable of causing partial discharges in said voids, said macromolecular polymer being a polyethylene, a polyester or a polyepoxide, the improvement, for promoting an increase of the voltage thresholds liable to cause said partial discharges, wherein said insulator comprises at least one metal chelate which is a derivative of an enolate or thioenolate of the formula

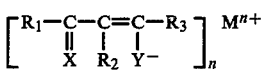

wherein $R_1$, $R_2$ and $R_3$ are each hydrogen or an alkyl, aryl, or cycloalkyl group or a heterocyclic group containing sulphur, oxygen or nitrogen as the heterocyclic atom and wherein said group may be substituted by one or more halogen atoms;

the total number of carbon atoms in the metal chelate is between 5 and 25;

$M^{n+}$ stands for a metal ion,

X and Y are independently oxygen or sulfur, and n is an integer from 1 to 4.

2. Electrical insulator in accordance with claim 1, wherein $R_1$, $R_2$, $R_3$ in said general formula are alkyl, cycloalkyl, or haloalkyl groups containing from 1 to 6 carbon atoms, phenyl groups or heterocyclic groups having 5 or 6 members, the heteroatoms of which are nitrogen, oxygen, or sulphur atoms.

3. Electrical insulator in accordance with claim 1 wherein the metal ion $M^{n+}$ in the general formula is selected from the group consisting of iron, copper, chromium, zirconium, vanadium, manganese, mercury, hafnium, cerium, europium, sodium, potassium, barium and aluminum.

4. Electrical insulator in accordance with claim 1, wherein the metal in the general formula is iron or titanium.

5. Electrical insulator in accordance with claim 1, wherein the enolates of said general formula are compounds in which $R_1$, $R_2$ and $R_3$ are respectively:

| $R_1$ | $R_2$ | $R_3$ |
|---|---|---|
| methyl | H | methyl |
| methyl | H | isobutyl |
| methyl | H | thenoyl |
| trifluoromethyl | H | trifluoromethyl |
| methyl | H | pyridyl |
| methyl | H | furyl |

-continued

| $R_1$ | $R_2$ | $R_3$ |
|---|---|---|
| phenyl | H | cyclohexyl |
| hexyl | H | isobutyl |
| methyl | methyl | methyl |
| metyl | hexyl | methyl |

6. An electrical insulator according to claim 5 wherein $R_1$ is methyl, $R_2$ is hydrogen, $R_3$ is methyl.

7. An electrical insulator according to claim 5 wherein $R_1$ is methyl, $R_2$ is hydrogen, $R_3$ is isobutyl.

8. An electrical insulator according to claim 5 wherein $R_1$ is methyl, $R_2$ is hydrogen, $R_3$ is thenoyl.

9. An electrical insulator according to claim 5 wherein $R_1$ is trifluoromethyl, $R_2$ is hydrogen, $R_3$ is trifluoromethyl.

10. An electrical insulator according to claim 5 wherein $R_1$ is methyl, $R_2$ is hydrogen, $R_3$ is pyridyl.

11. An electrical insulator according to claim 5 wherein $R_1$ is methyl, $R_2$ is hydrogen, $R_3$ is furyl.

12. An electrical insulator according to claim 5 wherein $R_1$ is phenyl, $R_2$ is hydrogen, $R_3$ is cyclohexyl.

13. An electrical insulator according to claim 5 wherein $R_1$ is hexyl, $R_2$ is hydrogen, $R_3$ is isobutyl.

14. An electrical insulator according to claim 5 wherein $R_1$ is methyl, $R_2$ is methyl, $R_3$ is methyl.

15. An electrical insulator according to claim 5 wherein $R_1$ is methyl, $R_2$ is hexyl, $R_3$ is methyl.

16. Electrical insulator in accordance with claim 5, wherein the enolate is represented by the formula:

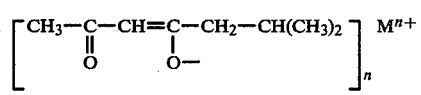

(II)

in which the metal is selected from the group consisting of Zn, Cu, Cr, Ce, Al, V, Fe, Ti.

17. Electrical insulator according to claim 16 wherein the metal is Fe or Ti.

18. Electrical insulator in accordance with claim 1 wherein the content of enolate is between 0.001 and 5% by weight.

19. Electrical insulator according to claim 18 wherein the content of enolate is between 0.01 and 1% by weight.

20. Electrical insulator according to claim 1 wherein the macromolecular compound is a low density polyethylene, free of any metal components except the enolates.

21. An electrical insulator according to claim 1 wherein M is a metal of the group consisting of mercury, hafnium, cerium, titanium, sodium, potassium, barium and europium.

22. An electrical insulator according to claim 1 wherein said metal chelate is present in an amount of 0.01 to 0.1 weight percent.

* * * * *

UNITED STATES PATENT AND TRADEMARK OFFICE

CERTIFICATE OF CORRECTION

PATENT NO. : 4,157,975

DATED : June 12, 1979

INVENTOR(S) : Barge et al.

It is certified that error appears in the above-identified patent and that said Letters Patent are hereby corrected as shown below:

Title Page, Ref. Cited, [56], "Braum" should read -- Braun --.

Column 4, line 53, delete "of" after "some".

Column 6, line 8, at the headings of the first four tables, "0,01""0,05"and"0,1" should all read respectively -- 0.01 0.05 0.1 --.

Column 10, line 7, claim 5, under column heading $R_1$, last line, "metyl" should read -- methyl --.

Signed and Sealed this

*Eleventh* Day of *December 1979*

[SEAL]

*Attest:*

SIDNEY A. DIAMOND

*Attesting Officer*

*Commissioner of Patents and Trademarks*